US009747741B2

(12) United States Patent
Sheng

(10) Patent No.: US 9,747,741 B2
(45) Date of Patent: Aug. 29, 2017

(54) IN-POCKET CURRENCY BUNDLER

(71) Applicant: Toshiba International Corporation, Houston, TX (US)

(72) Inventor: Jun Sheng, Lewisville, TX (US)

(73) Assignee: Toshiba International Corporation, Houston, TX (US)

( * ) Notice: Subject to any disclaimer, the term of this patent is extended or adjusted under 35 U.S.C. 154(b) by 6 days.

(21) Appl. No.: 14/661,645

(22) Filed: Mar. 18, 2015

(65) Prior Publication Data

US 2016/0275745 A1 Sep. 22, 2016

(51) Int. Cl.

| | |
|---|---|
| ***B65B 27/08*** | (2006.01) |
| ***G07D 11/00*** | (2006.01) |
| ***B65H 7/02*** | (2006.01) |
| ***B65H 20/00*** | (2006.01) |
| ***B65H 39/10*** | (2006.01) |
| ***B65H 43/00*** | (2006.01) |

(52) U.S. Cl.

CPC ..... *G07D 11/0021* (2013.01); *B65B 27/08* (2013.01); *B65H 7/02* (2013.01); *B65H 20/005* (2013.01); *B65H 39/10* (2013.01); *B65H 43/00* (2013.01); *G07D 11/0051* (2013.01); *G07D 11/0081* (2013.01); *G07D 11/0084* (2013.01)

(58) Field of Classification Search

CPC ..... G07D 11/0021; B65H 39/10
USPC ..... 270/58.07; 194/206, 207; 53/399, 582
See application file for complete search history.

(56) References Cited

U.S. PATENT DOCUMENTS 4,141,193 A * 2/1979 Joa ..... B65B 25/20 198/408
4,374,463 A * 2/1983 Omura ..... G07D 7/12 53/54
4,376,364 A * 3/1983 Horino ..... G07D 7/04 209/534
5,126,002 A * 6/1992 Iwata ..... B65B 27/08 156/468
5,522,511 A * 6/1996 Sakoguchi ..... G07D 11/0081 209/534
6,185,905 B1 * 2/2001 Neri ..... B65H 33/00 53/399
6,318,053 B1 11/2001 Frank et al.
6,568,154 B1 * 5/2003 Lundblad ..... B65H 29/006 53/131.5

(Continued)

FOREIGN PATENT DOCUMENTS

JP 05233927 A * 9/1993

*Primary Examiner* — Patrick Mackey
(74) *Attorney, Agent, or Firm* — Baker Botts L.L.P.

(57) ABSTRACT

Presently disclosed embodiments are directed to systems and methods for bundling smaller stacks of bank notes into larger sized bundles that are efficient for transportation. The system may include an in-line bundler disposed along pockets of a currency processor for receiving stacks of bank notes directly from the pocket. That way, the smaller stacks of bank notes do not have to be removed from the currency processor and transported to a separate bundler machine. Instead, the currency processor features a desired number of bundler machines disposed in-line with the corresponding pockets where the bank notes are initially received and stacked. This arrangement may enable efficient stacking and bundling of bank notes sorted via the currency processor.

19 Claims, 12 Drawing Sheets

(56) References Cited

U.S. PATENT DOCUMENTS

| | | | | |
|---|---|---|---|---|
| 7,779,982 | B2 * | 8/2010 | Fitzgerald | G07D 11/0081 194/206 |
| 8,714,335 | B2 * | 5/2014 | Hallowell | 194/206 |
| 2014/0190132 | A1 * | 7/2014 | De Matteis | B65H 29/243 53/582 |

* cited by examiner

IN-POCKET CURRENCY BUNDLER

TECHNICAL FIELD

Embodiments of the present disclosure relate to automated currency processing and, more particularly, to a bank note processing system having in-pocket currency bundlers.

BACKGROUND

Automated currency processors or bank note processing machines are common in the fields of bulk currency processing and are typically used by central banks, large commercial banks, print works, cash in transit, or other entities that require processing of large amounts of currency.

In operation, bank notes that require processing are fed into the automated currency processing machine by a feeder. The term "bank note" (or "note") as used herein may generally include bills of different currencies, checks, or other instruments that are typically processed by a banking entity. The bank notes then travel down a conveyor past a number of detector modules which detect various characteristics of the bank note. For instance, the detector modules may determine denomination, authenticity, bank note condition, or other desired characteristics of a bank note. Based on the characteristics detected, the bank note may then be routed to a number of different pockets for collation or destruction. These pockets may enable the automated currency processing machine to sort notes by fitness level, denomination, origin, authentication, or other desired characteristics.

In traditional currency processors, bank notes that are routed into pockets for collation are banded into stacks of a certain number of bank notes (e.g., 100 bank notes). After such collection and banding, the stacks of bank notes can be removed from the currency processor and later combined with additional stacks to form larger bundles of bank notes for transportation, storage, and other processes. The initial stacks of bank notes produced using the currency processor are generally inefficient for transporting bank notes over large distances.

SUMMARY

In accordance with the above, presently disclosed embodiments are directed to a currency processor or bank note processing machine having one or more in-line bundlers that can be used to bundle smaller stacks of bank notes into larger sized bundles that are efficient for transportation. The in-line bundlers may be disposed along pockets of the currency processor for receiving the stacks of bank notes directly from the pocket. That way, the smaller stacks of bank notes do not have to be removed from the currency processor and transported to a separate bundler machine. Instead, the currency processor features a desired number of bundler machines disposed in-line with the corresponding pockets where the bank notes are initially received and stacked. This arrangement may enable efficient stacking and bundling of bank notes sorted via the currency processor.

To that end, the in-line bundler may include a receptacle for receiving a plurality of straps of bank notes from a stacking apparatus in the pocket. The in-line bundler may also include an actuation mechanism (e.g., extension mechanism) for pushing the plurality of straps of bank notes through a wrapping material held between two spools, in order to wrap the plurality of straps of bank notes into a bundle appropriately sized for transportation. In some embodiments, the in-line bundler may include an outlet tray for outputting the bundle from the in-line bundler. The in-line bundler may also include a sealing assembly for sealing the wrapping material around the straps of bank notes and cutting the wrapping material so that one section of the wrapping material is sealed around the bank notes while another section of the wrapping material remains extending between the two spools. The in-line bundler may be disposed in a larger bundler assembly that includes the stacking apparatus used to stack the bank notes into straps as well as a portion of the conveying path used to deliver the bank notes through the bank note processing machine and into selected pockets. Such bundler assemblies may be modular in design so that they can be easily added to or removed from the bank note processing machine.

BRIEF DESCRIPTION OF THE DRAWINGS

The present invention will be more fully understood by reference to the following detailed description of the preferred embodiments of the present invention when read in conjunction with the accompanying drawings, in which like reference numbers refer to like parts throughout the views, wherein.

DETAILED DESCRIPTION

Illustrative embodiments of the present disclosure are described in detail herein. In the interest of clarity, not all features of an actual implementation may be described in this specification. It will of course be appreciated that in the development of any such actual embodiment, numerous implementation specific decisions must be made to achieve the specific implementation goals, which will vary from one implementation to another. Moreover, it will be appreciated that such a development effort might be complex and time-consuming, but would nevertheless be a routine undertaking for those of ordinary skill in the art having the benefit of the present disclosure. To facilitate a better understanding of the present disclosure, the following examples of certain embodiments are given. In no way should the following examples be read to limit, or define, the scope of the disclosure.

Figure 1:
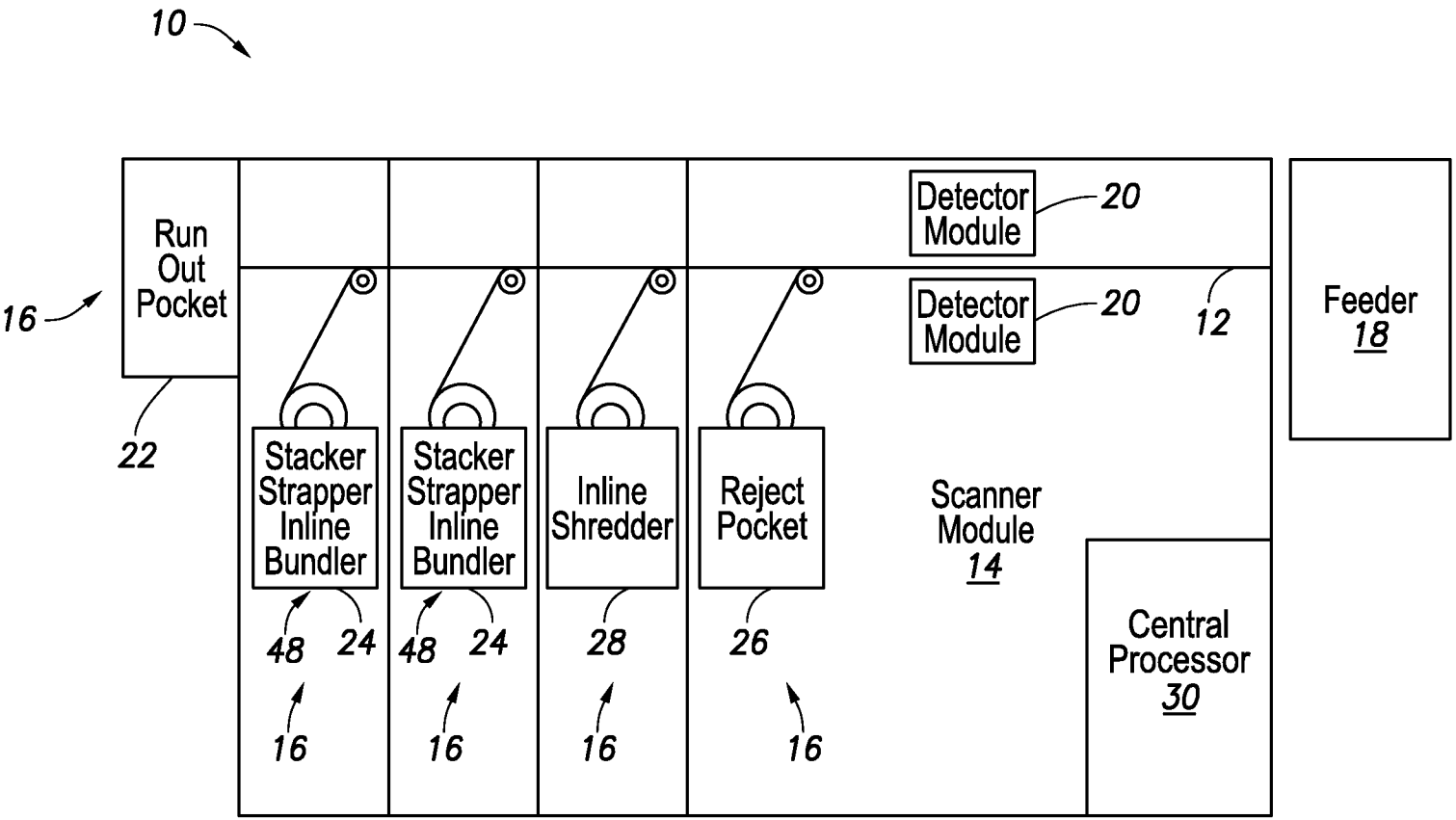
FIG. 1 is a bock diagram illustrating a bank note processing machine having in-line bundler assemblies, in accordance with an embodiment of the present disclosure.

Turning now to the drawings, FIG. 1 illustrates a block diagram of a bank note processing machine 10 according to an embodiment of the present disclosure. The bank note processing machine 10 may include a conveying path 12, a scanner module 14, and a plurality of pockets 16 disposed at different axial positions along the conveying path 12. The conveying path 12 may be designed to transport individual bank notes through the bank note processing machine 10. The conveying path 12 may be positioned and aligned within the bank note processing machine 10 to receive bank notes from a feeder 18. As illustrated, the feeder 18 may be separate from the overall bank note processing machine 10.

The conveying path 12 may feature conveyors or other components used to strip one bank note at a time from a stack of notes in the feeder 18.

Once the bank note processing machine 10 receives the bank note from the feeder 18, the bank note may be sent along the conveying path 12 to the scanner module 14. The scanner module 14 may include one or more detector modules 20 disposed along and centered over the conveying path 12. The detector modules 20 may be disposed above, below, or both above and below the conveying path to detect characteristics from the front and back sides of the bank notes transported along the conveying path 12. The detector modules 20 may include any suitable detectors known to those of ordinary skill in the art, having the benefit of the present disclosure. For instance, the detector modules 20 may be ultraviolet detectors which may check the note for soiling. One or more of the detector modules 20 may be optical detection modules having fluorescence and/or phosphorescence detectors. The detector modules 20 in the scanner module 14 may be used to identify counterfeit bank notes, damaged bank notes, denominations of the bank notes, or other desirable characteristics. Although two detector modules 20 are shown in FIG. 1, the present disclosure is not limited to any specific number of detector modules. Accordingly, fewer or more detector modules may be used without departing from the scope of the present disclosure.

One or more bank notes may travel along the conveying path 12 past the detector modules 20. The conveying path 12 may direct the bank notes to one of several available final disposition components (e.g., pockets 16). These final disposition components may include, for example, a pocket 22 for collection of processed bank notes, one or more in-line bundler assemblies 48, a designated pocket 26 where the bills may be inspected and/or rejected, and an in-line shredder 28. The in-line bundler assemblies 48 may include in-line bundlers 24 be designed to receive bank notes of a certain currency and to arrange the bank notes into easily transportable bundles. The in-line shredder 28 may be used to shred bank notes that are determined to be flawed or counterfeit. In addition to these destination components, the bank note processing machine 10 may include a system for depositing the bank notes into the appropriate pocket, shredder, bundler, etc., by pulling the bank notes from the conveying path 12 at a desired point. For instance, in certain implementations, counterfeit bank notes identified by the detection modules 20 may be directed to the shredder 28 where they may be shredded.

The bank note processing machine 10 may include a central processor 30 for controlling the timing of the system, the activation of the detectors 20, and the control of bank note distribution. The central processor 30 may either be a single processing unit or it may include multiple processors. The bank note processing machine 10 may also include computer-readable media (e.g., memory or storage) for storing computer code that may be used to control the central processor 30 as well as other parameters relating to operation of the system. The central processor 30 may be capable of running the stored program steps from the accessible memory. The central processor 30 may include a dedicated general purpose computer, an embedded RISC or CISC computer processor, a digital signal processor (DSP), or the like.

As illustrated, the disclosed bank note processing machine 10 may include one or more in-line bundlers 24 for arranging a desired number of bank notes into a bundle that is appropriately sized for transportation. In the disclosed embodiments, the in-line bundlers 24 may work in conjunction with respective stackers (or strappers) of the bank note processing machine 10. The stackers/strappers may receive and dispose incoming bank notes into stacks of a certain number (e.g., 100 bank notes). The in-line bundler 24 may receive the stacked bank notes from the stacker/strapper, arrange a desired number of these stacks (e.g., 10 stacks) into a bundle, and deposit the bundle from the bank note processing machine 10. In this manner, the disclosed bank note machine 10 may be designed to arrange several smaller stacks of bank notes into a bundle that is appropriately sized for transportation to another location.

Figure 2:
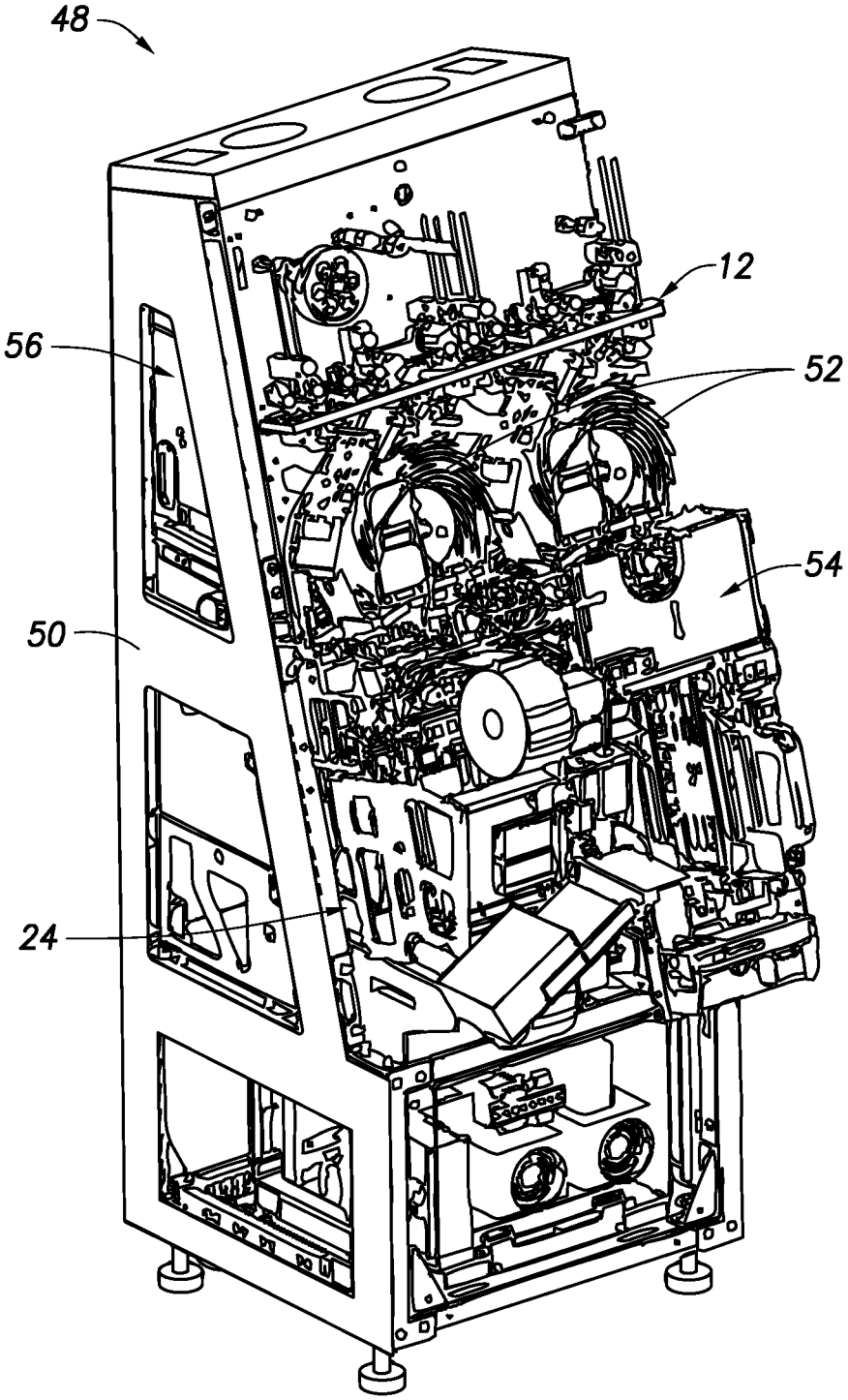
FIG. 2 is a perspective view of an in-line bundler assembly having an in-line bundler, in accordance with an embodiment of the present disclosure.
Figure 3:
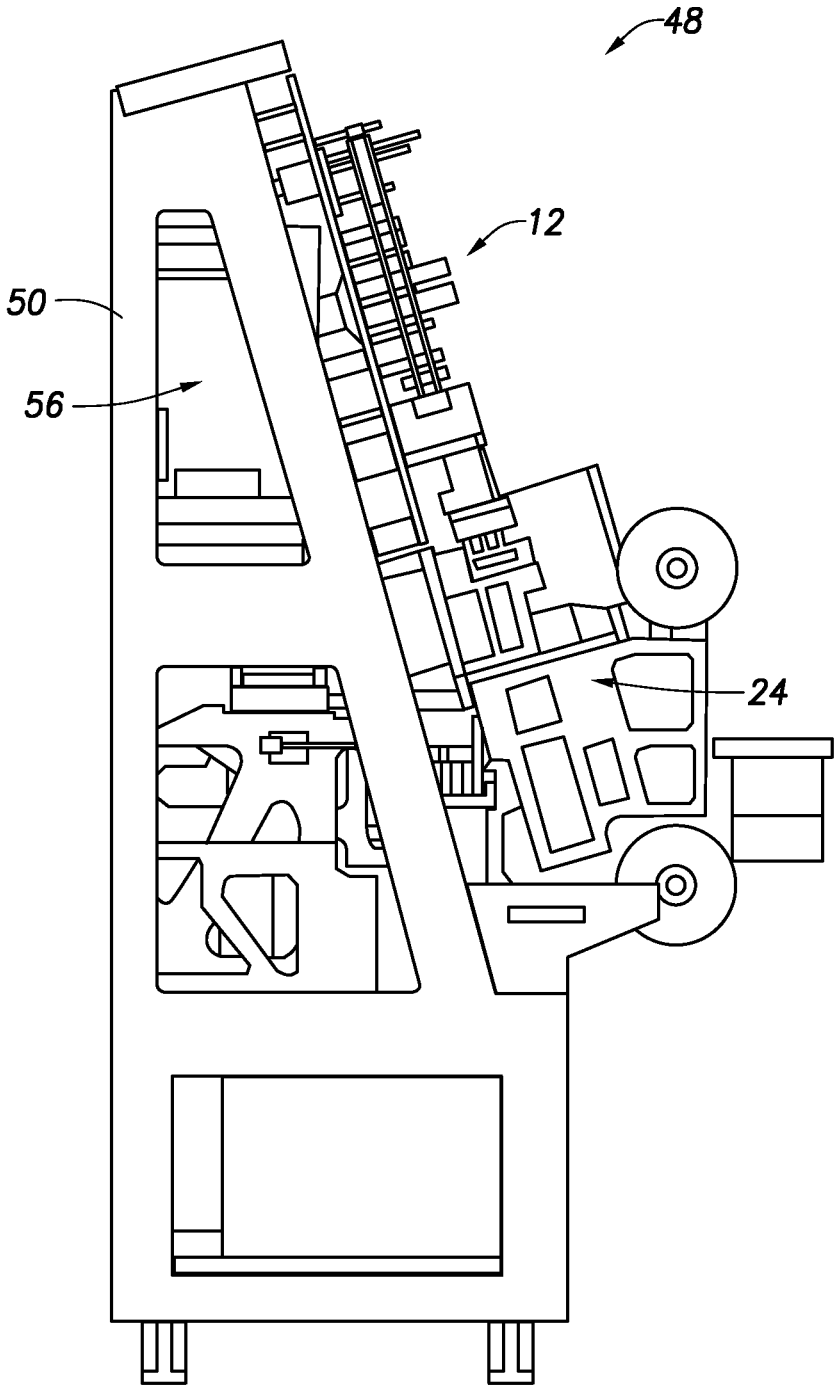
FIG. 3 is a side view of the in-line bundler assembly of FIG. 2, in accordance with an embodiment of the present disclosure.

FIGS. 2 and 3 illustrate a detailed embodiment of an in-line bundler assembly 48 having one of the in-line bundlers 24 that may be used in the bank note processing machine 10 described above. The in-line bundler assembly 48 may be a modular component that may be combined with other similarly shaped in-line bundler assemblies 48 in the bank note processing machine. Thus, the in-line bundler assemblies 48 may be positioned end-to-end and used to separate and bundle a variety of bank notes having different values or different currencies. Each of the in-line bundler assemblies 48 may be used to bundle bank notes of a different denominations or currency, thus enabling a single bank note processing machine to sort, stack, and bundle different types of bank notes that are fed into the system.

The in-line bundler assembly 48 may include, among other things, a chassis 50. The chassis 50 may act as a support structure for holding various parts of the in-line bundler assembly 48 in their desired arrangement. As illustrated, the in-line bundler assembly 48 may feature an in-line bundler 24 positioned within the chassis 50. In some embodiments, the in-line bundler 24 may be removably coupled to the chassis 50, in order to facilitate relatively efficient removal, replacement, and maintenance of the in-line bundler 24.

The in-line bundler assembly 48 may also include a portion of the conveying path 12. This portion of the conveying path 12 may utilize rollers, stationary conveyor pieces, and rotatable conveyor pieces to deliver the bank notes to a desired location. For example, the conveyor path 12 may operate to deliver bank notes from one end of the illustrated in-line bundler assembly to an opposite end. At other times, the pieces of the conveyor path 12 may be operated to deliver one or more bank notes from the conveyor path 12 into a feeder component 52 that feeds the bank notes to a stacking apparatus 54 of the in-line bundler assembly 48. The stacking apparatus 54 may receive the bank notes delivered via the feeder component 52 and stack the bank notes into a stack (or strap) having a desired number of bank notes.

The stacking apparatus 54 may work together with the in-line bundler 24 to stack and bundle the bank notes into an easily transportable configuration. For example, the stacking apparatus 54 may arrange the received bank notes into a stack of 100 bank notes. In some embodiments, this arrangement into a stack may include wrapping and/or sealing the stack of bank notes. The in-line bundler 24 may receive a desired number of the stacks of bank notes from the stacking apparatus 54, and may cover and/or seal the multiple stacks into a bundle for output from the in-line bundler assembly 48. In other embodiments, the in-line bundler assembly 48 may receive a large number of bank notes directly from the conveying path 12 (via one or more of the feeder components 52), stack the bank notes, and bundle all the stacked bank notes into a transportable bundle.

In some embodiments, the in-line bundler assembly 48 may include a motor control section 56 disposed in another section of the chassis 50 and coupled to the moveable pieces of the conveyor path 12. The motor control section 56 may include motors and control devices used to manipulate the operation of the conveyor path 12 based on control signals received, for example, from the central processor 30 of FIG. 1. That is, the motor control section 56 may receive a control signal from the central processor in response to the scanner module determining that an incoming bank note has a certain denomination. Upon receiving this control signal, the motor control section 56 may control the conveying path 12 by tilting one or more of the conveyor pieces of the conveying path 12 at a certain time, in order to drop the identified bank note into the desired feeder component 52 of the in-line bundler assembly 48. At other times, the motor control section 56 may maintain the conveying path 12 in a relatively straight configuration to feed bank notes through that section of the conveying path 12 when the bank notes moving therethrough are not the desired denomination for that specific in-line bundler assembly 48.

The in-line bundler assembly 48 may include other features than those shown and/or described with reference to FIGS. 2 and 3. For example, some embodiments of the in-line bundler assembly 48 may include one or more processor components, power sources, and other features. Any number of in-line bundler assemblies 48 may be disposed end to end and coupled together to create a bank note processing machine having a desired number of bundling pockets. These in-line bundler assemblies 48 may further include wheels or stationary supports disposed at the bottom of the chassis 50 for supporting the in-line bundler assemblies 48 in their desired positions with respect to the other components of the bank note processing machine.

Figure 4A:
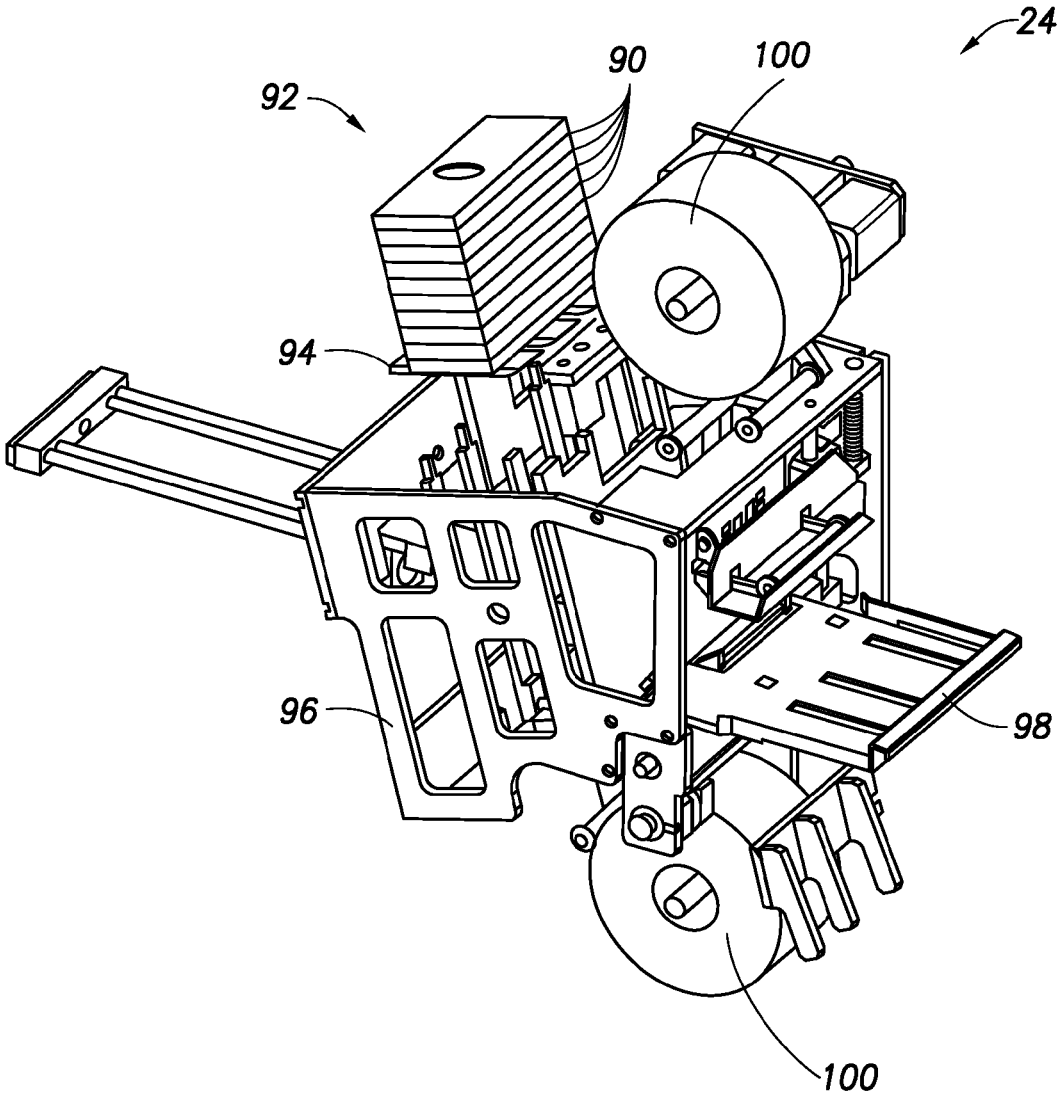
FIGS. 4A-4I illustrate the in-line bundler of FIGS. 2 and 3 being used to bundle stacks of bank notes, in accordance with an embodiment of the present disclosure.

FIGS. 4A-4I illustrate the in-line bundler 24 being used to bundle together several stacks of bank notes into a transportable package. Prior to this illustrated bundling process, the banknotes may be processed and packaged into straps 90 of a desired number of bank notes (e.g., 100 bank notes in each strap 90). As illustrated in FIG. 4A, the in-line bundler 24 may be equipped to bundle ten straps 90 of stacked bank notes at a time. In other embodiments, the in-line bundler 24 may be able to handle more or fewer straps than ten. It should be noted that, although the in-line bundler 24 is illustrated as bundling a group 92 of ten straps 90 of bank notes, the same in-line bundler 24 may be used to bundle groups 92 of fewer or more straps 90. For simplicity, the term "group" 92 will be used to identify the plurality of straps 90 that are being combined together into a single bundle.

First, the in-line bundler 24 may receive the group 92 of straps output from the stacking apparatus. The group 92 of straps may be received onto an elevated platform 94 of the in-line bundler 24. As illustrated, the straps 90 disposed in the group 92 may be received onto the platform 94 in a stacked configuration such that the platform 94 only directly contacts the bottom strap 90 in the group 92. The platform 94 may be elevated to a position adjacent an outlet of the stacking apparatus (described above) that was used to stack the bank notes and strap them together into individual straps 90. In the illustrated embodiment, the platform 94 may be maintained in the elevated position while it is loaded with the group 92 of straps. In other embodiments, the platform 94 may be lowered slightly to position the top-most strap to function as the bottom of each additional strap 90 that is received in the stacked arrangement on the platform 94.

In addition to the platform 94 for receiving the group 92 of straps, the in-line bundler 24 may include an outer frame 96, an outlet tray 98, and two spools 100. The outer frame 96 may be used to couple the in-line bundler 24 with the chassis (50, shown in FIG. 2) or some other mechanical support feature of the in-line bundler assembly 48. The outlet tray 98 may be used to output a bundle (holding the group 92 of stacked bank notes) from the in-line bundler 24. The two spools 100 may hold a wrapping material that is used to wrap the group 92 of stacked bank notes into a bundle for transportation. The wrapping material may be stretched between the two spools 100, and components of the in-line bundler 24 may be used to selectively break and re-seal portions of the wrapping material throughout the process of bundling successive groups 92 of bank note stacks.

In some embodiments, the wrapping material may be approximately the same width as the strapping material used to holds the individual straps 90 of bank notes. In other embodiments, the wrapping material may be wider (e.g., at least approximately 80% as wide as the group 92 of straps) than such strapping material. In further embodiments, the wrapping material may be thinner (e.g., ribbon, rope, etc.) than the strapping material. The wrapping material may be made from foil or some similar metallic material in some embodiments.

Figure 4B:
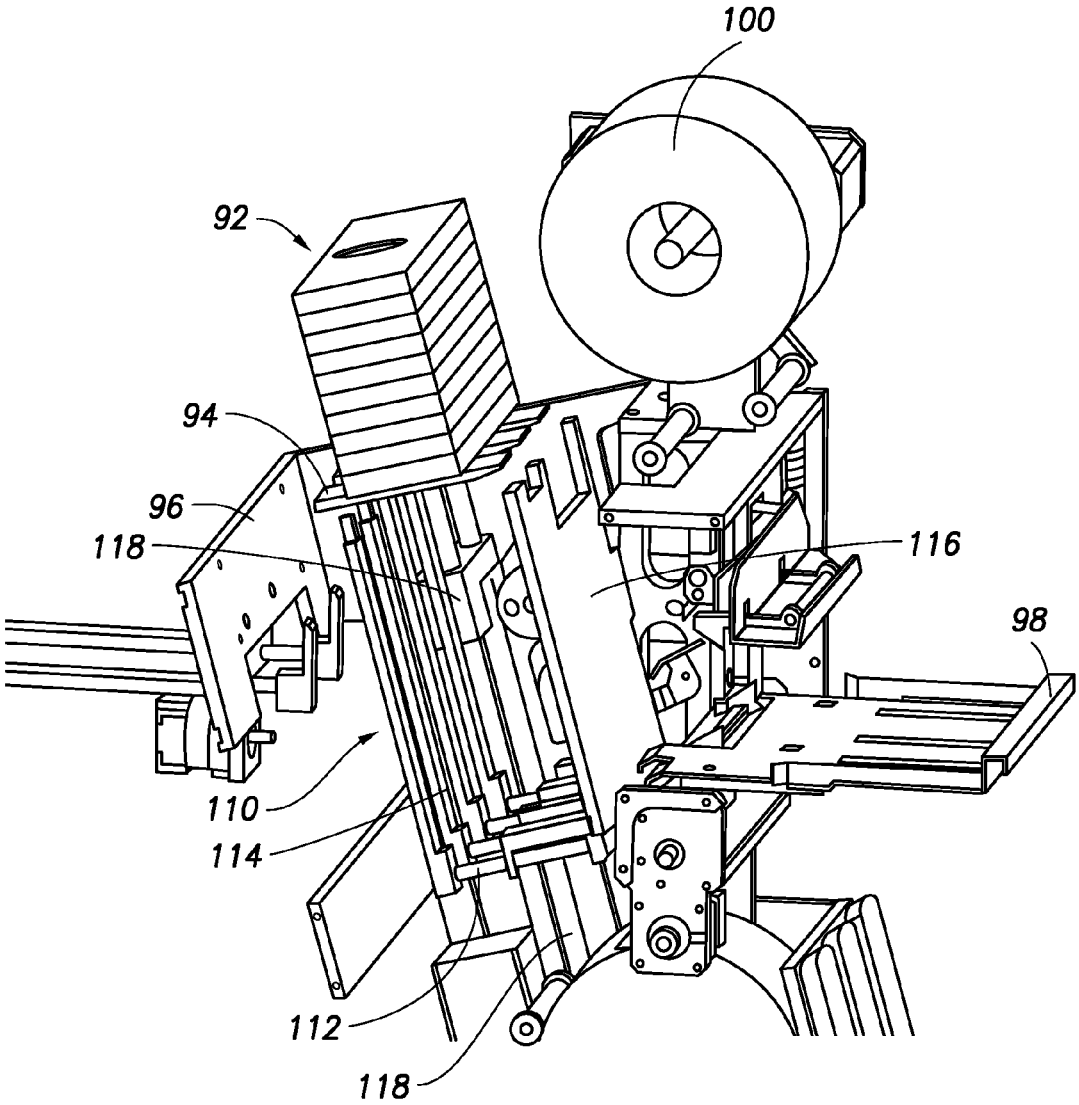
Figure 4C:
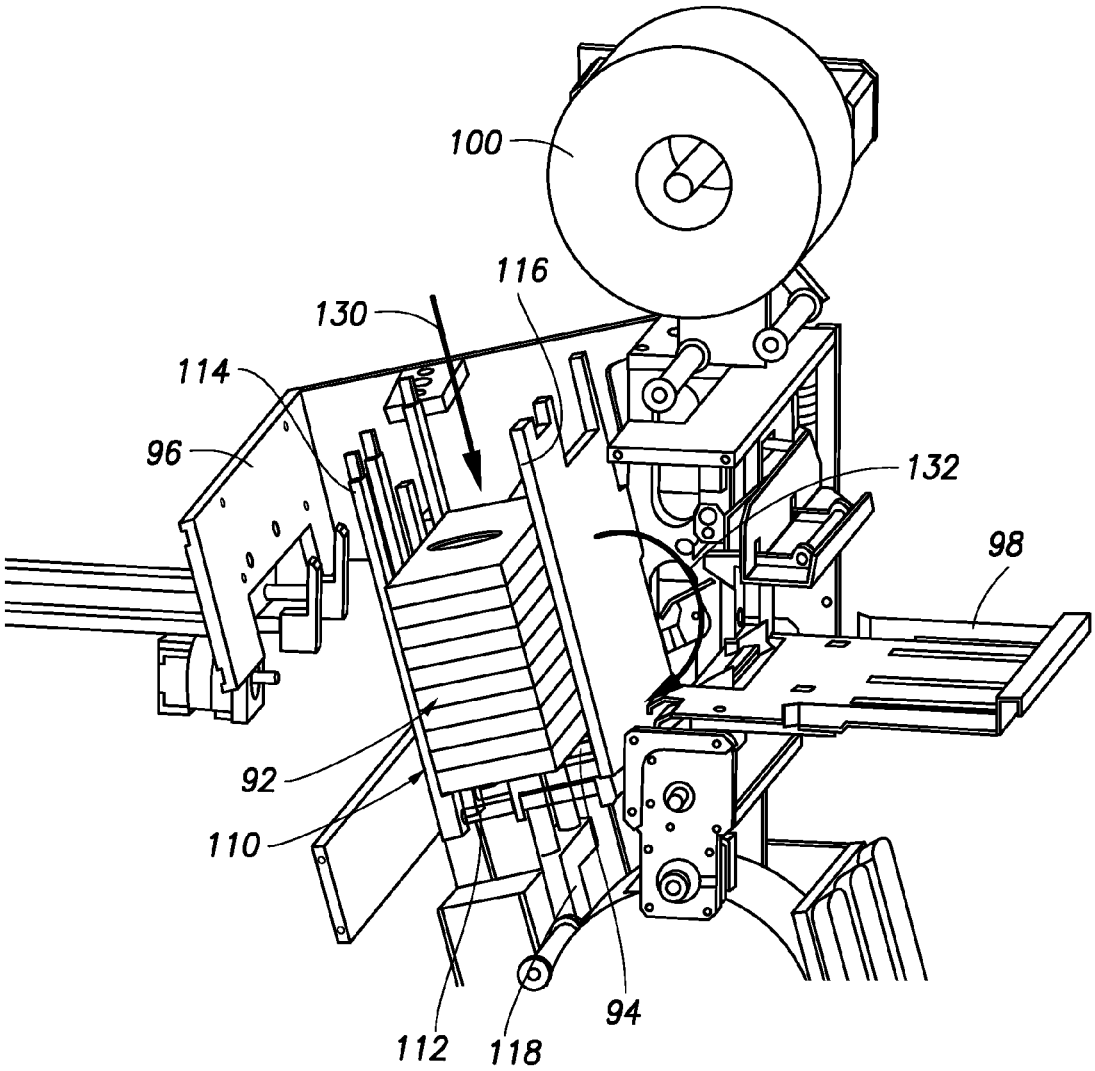

FIG. 4B shows the in-line bundler 24 (inside a front face of the outer frame 96) receiving the group 92 of bank note straps. The illustrated figure shows a more detailed view of the inner components of the in-line bundler 24. For example, the in-line bundler 24 may include a receptacle 110 designed to receive the group 92 of bank notes disposed on the platform 94. The platform 94 holding the group 92 of bank notes may be lowered into the receptacle 110, as shown in FIG. 4C, to dispose the stacks of bank notes within the in-line bundler 24. The receptacle 110 may be rotatable with respect to the outer frame 96 of the in-line bundler 24, in order to manipulate the group 92 of bank notes as desired.

As illustrated, the receptacle 110 may include multiple faces that work together to receive and manipulate the group 92 of bank notes. These faces may include, for example, a slotted lower face 112 that forms a lower end of the receptacle 110 in the illustrated embodiment. The faces may also include two side faces 114 and 116. One of the side faces 114 may be slotted, while the other face 116 may be flat. Other types, arrangements, and numbers of faces may be used to form the receptacle 110 for receiving and rotating the group 92 of bank notes.

The illustrated platform 94 may be a slotted platform designed to support the group 92 of bank notes that were previously stacked and strapped. The slotted pattern on the platform 94 may be designed to pass through the slotted passages formed in the lower face 112 of the receptacle 110. The platform 94 may initially be elevated with respect to the receptacle via an extension mechanism 118 (e.g., hydraulic piston). The extension mechanism 118 may extend through the lower slotted face 112 of the receptacle 110, and may be selectively extended and contracted to move the group 92 of bank notes relative to the receptacle 110.

As shown in FIG. 4C, the extension mechanism 118 may contract along its length to lower (arrow 130) the group 92 of bank notes into the receptacle 110. At this point, the group 92 of bank notes may be lowered into contact with the lower face 112 of the receptacle 110 and in a position between the side faces 114 and 116 of the receptacle 110. The extension mechanism 118 may lower the group 92 of bank notes so far downward that the platform 94 at the distal end of the extension mechanism 118 moves through the slots in the lower face 112 and out of the receptacle 110, thus leaving the bank notes entirely supported by the lower face 112 of the receptacle 110.

Figure 4D:
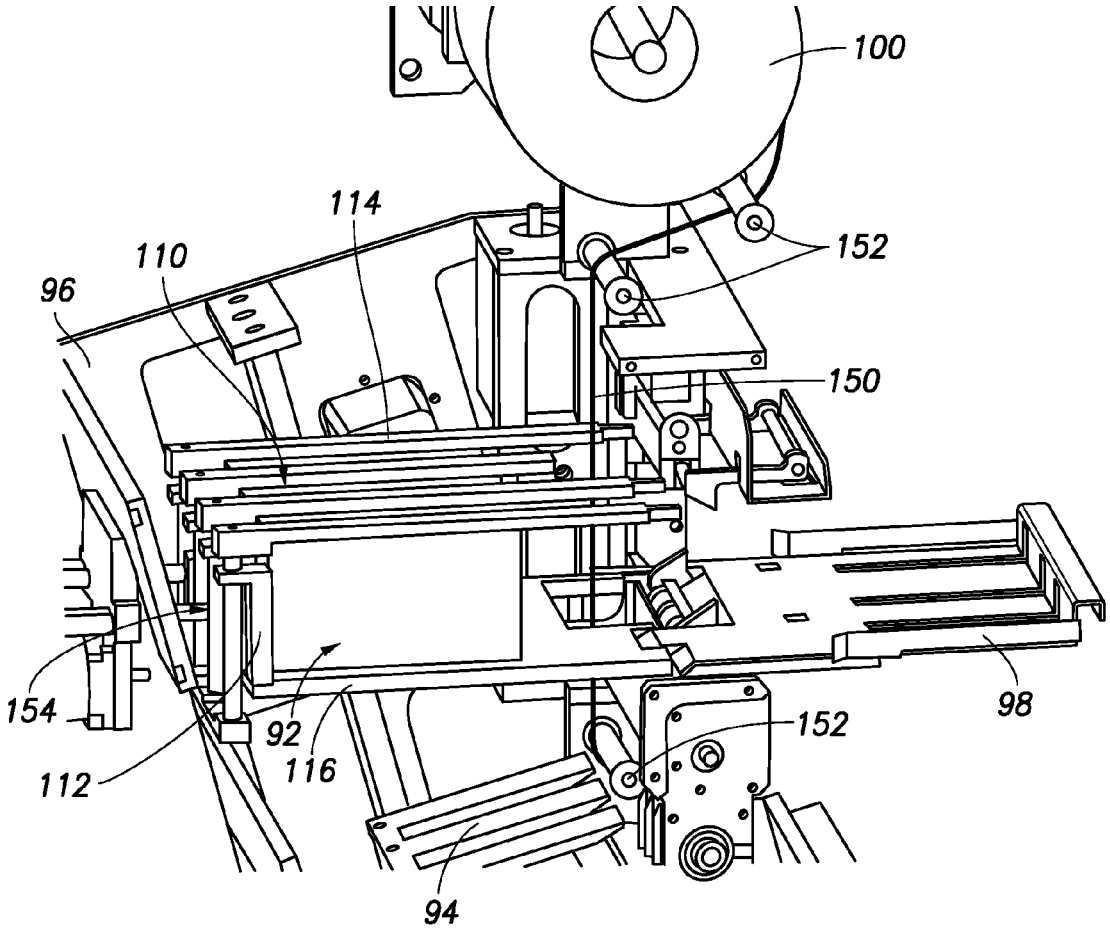

Once the group 92 of bank notes are supported in the receptacle 110, the receptacle may rotate (arrow 132) relative to the outer frame 96 of the in-line bundler 24 to rotate the stacked group 92 of bank notes into a position in line with the outlet tray 98. FIG. 4D shows the receptacle 110 rotated to move the group 92 of bank notes into this orientation. As illustrated, the platform 94 at the end of the extension mechanism has been lowered out of contact with the receptacle 110 so that it does not interfere with this rotation. In this position, the side face 116 of the receptacle 110 may be disposed in alignment with the outlet tray 98, so that the group 92 of bank notes may be easily pushed into the outlet tray 98.

As mentioned above, the in-line bundler 24 may utilize a wrapping material 150 to wrap the group 92 of bank notes into a transportable bundle arrangement. The wrapping material 150, as shown, may be held in tension between the two spools 100. The in-line bundler 24 may include rollers 152 disposed at certain positions relative to the spool 100, and the wrapping material 150 may be directed over these rollers 152 while being held between the spools 100. These rollers 152 may help to maintain the wrapping material 150 in a desired alignment within the in-line bundler 24 as the spools 100 transition from being fully loaded with wrapping material 150 to empty. As illustrated, the wrapping material 150 may extend vertically in a space between the receptacle 110 and the outlet tray 98. The wrapping material 150 may be held such that it extends in a direction that is substantially (e.g., within approximately 10 degrees) perpendicular to a direction in which the straps of bank notes are stacked in the group 92.

The in-line bundler 24 may include another extension mechanism 154 (e.g., hydraulic piston) having a slotted pushing face at a distal end thereof. The extension mechanism 154 may be disposed adjacent the lower face 112 of the receptacle 110 when the receptacle 110 is rotated in the position shown in FIG. 4D. From this position, the extension mechanism 154 may be extended (arrow 170) through the lower face 112 of the receptacle 110 to push the group 92 of bank notes from the side face 116 of the receptacle 110 to the outlet tray 98, as shown in FIG. 4E.

As the extension mechanism 154 moves the group 92 of bank notes from the receptacle 110 to the outlet tray 98 as shown, the group 92 may push against a latching mechanism 172. In some embodiments, the latching mechanism 172 may be spring-loaded such that the latching mechanism 172 is biased toward the group 92 of bank notes being pushed onto the outlet tray 98. In the illustrated embodiment, the spring-loaded latching mechanism 172 may include a slanted edge that can ride along an upper edge of the group 92 of bank notes as the group 92 is pushed past the latching mechanism 172. In FIG. 4E, the latching mechanism 172 is illustrated in this position riding along and being raised upward by the upward facing edge of the group 92 of bank notes. Once the group 92 of bank notes is entirely past the latching mechanism 172 and supported on the outlet tray 98, the latching mechanism 172 may be released into a latched position, as shown in FIG. 4F. From this latched position, the latching mechanism 172 may abut the group 92 in order to maintain the group 92 on the outlet tray 98. This may allow the extension mechanism 154 to be returned to its initial position without pulling any of the bank notes back toward the receptacle 110.

Figure 4E:
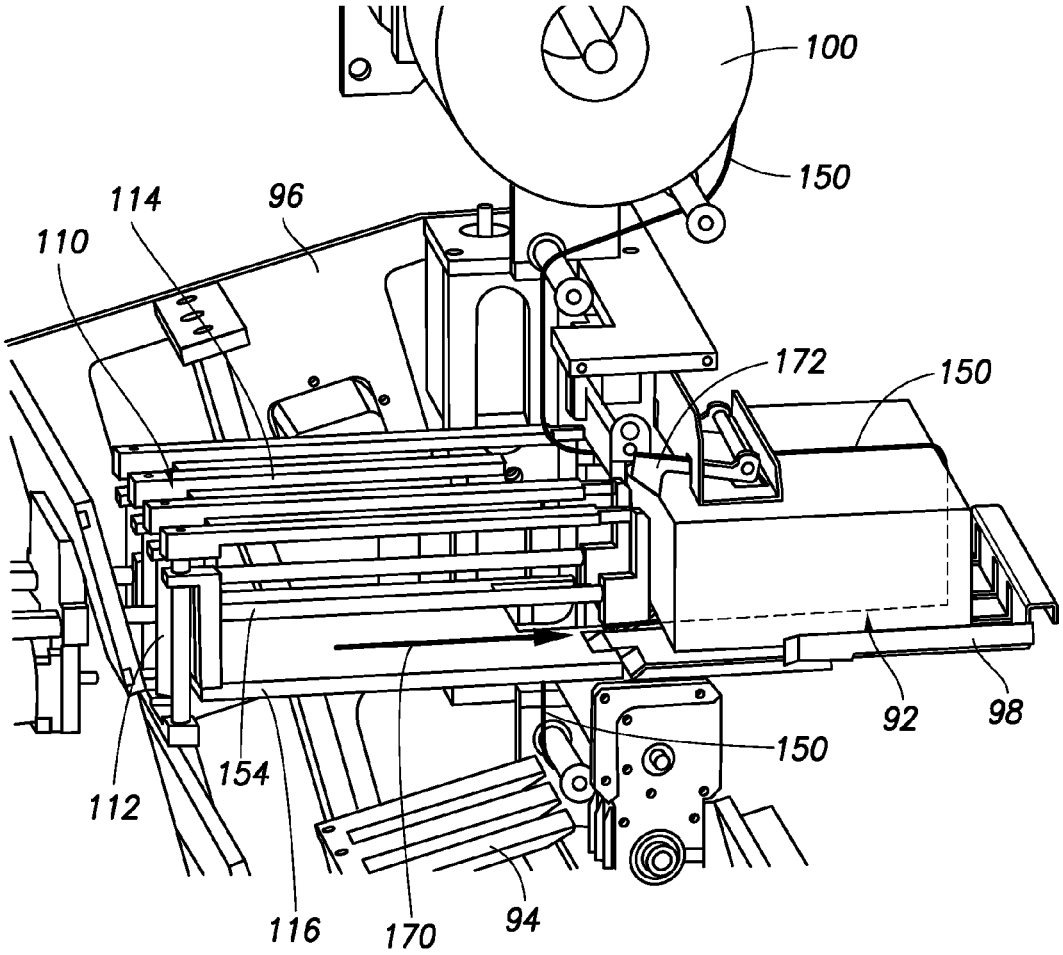
Figure 4F:
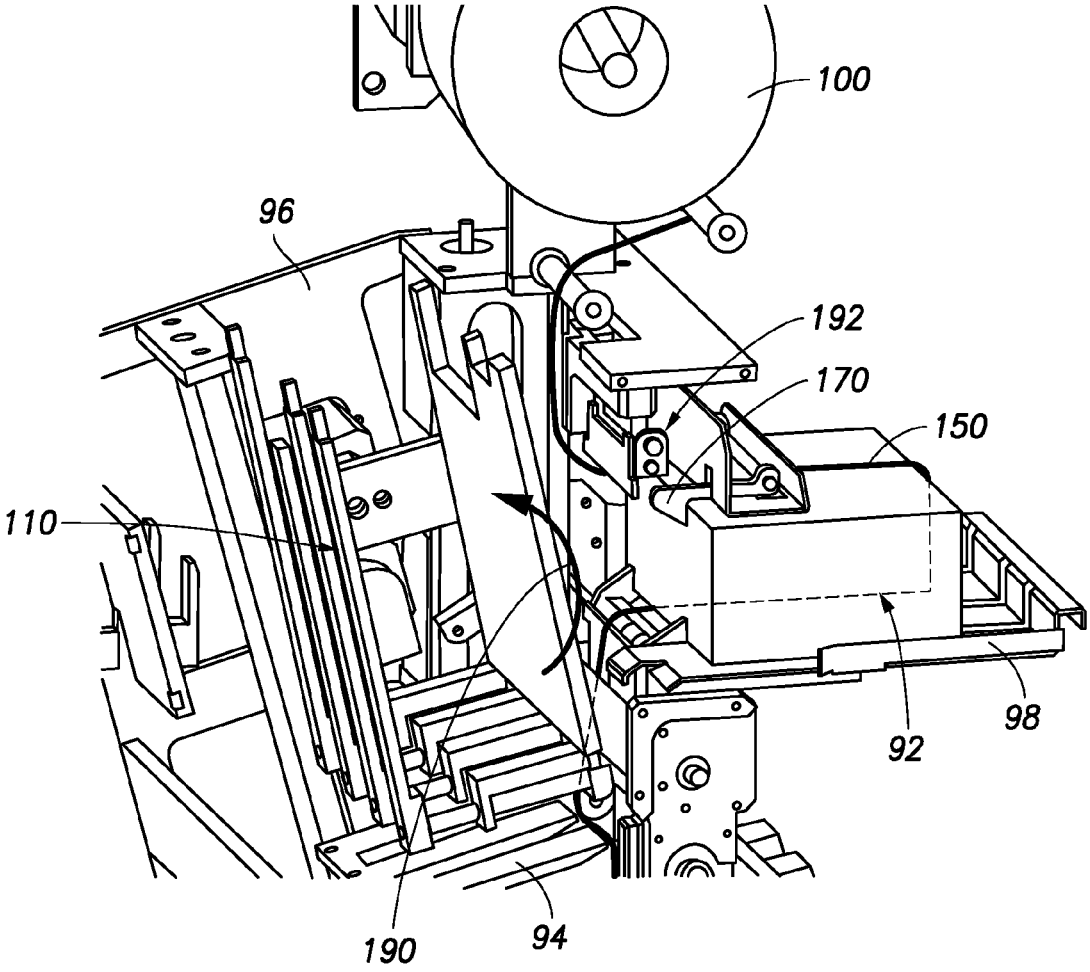

As illustrated in FIG. 4E, a section of the wrapping material 150 extending between the two spools 100 may be wrapped around three sides of the group 92 of bank notes as the group 92 is pushed from the receptacle 110 to the outlet tray 98. That is, the extension mechanism 154 may push the group 92 toward the outlet tray 98 such that a front end of the group 92 of bank notes contacts and extends the amount of wrapping material 150 released from the spools 100. The wrapping material 150 may be held in tension against the front of the group 92 so that the group 92 is held secure. Once the group 92 of bank notes is received at the outlet tray 98, the wrapping material 150 may reach around two additional sides of the stacks of bank notes. The wrapping material 150 may reach around these two sides in a direction substantially parallel to a stacking direction of the stacked bank notes that make up the group 92.

As shown in FIG. 4F, the group 92 of bank notes may be positioned on the outlet tray 98 with the wrapping material 150 extending around at least three sides of the group 92 and the latching mechanism 172, along with the tension in the wrapping material 150, holding the group 92 of bank notes in place. At this point, the above described extension mechanism 154 may be returned to its collapsed state and the receptacle 110 may be rotated (arrow 190) back to its substantially vertical orientation, ready to receive another group of stacked bank notes. As illustrated, the wrapping material 150 may extend around the rollers 152 as well as a sealing assembly 192 of the in-line bundler 24 on its way to the periphery of the group 92 of bank notes.

Figure 4G:
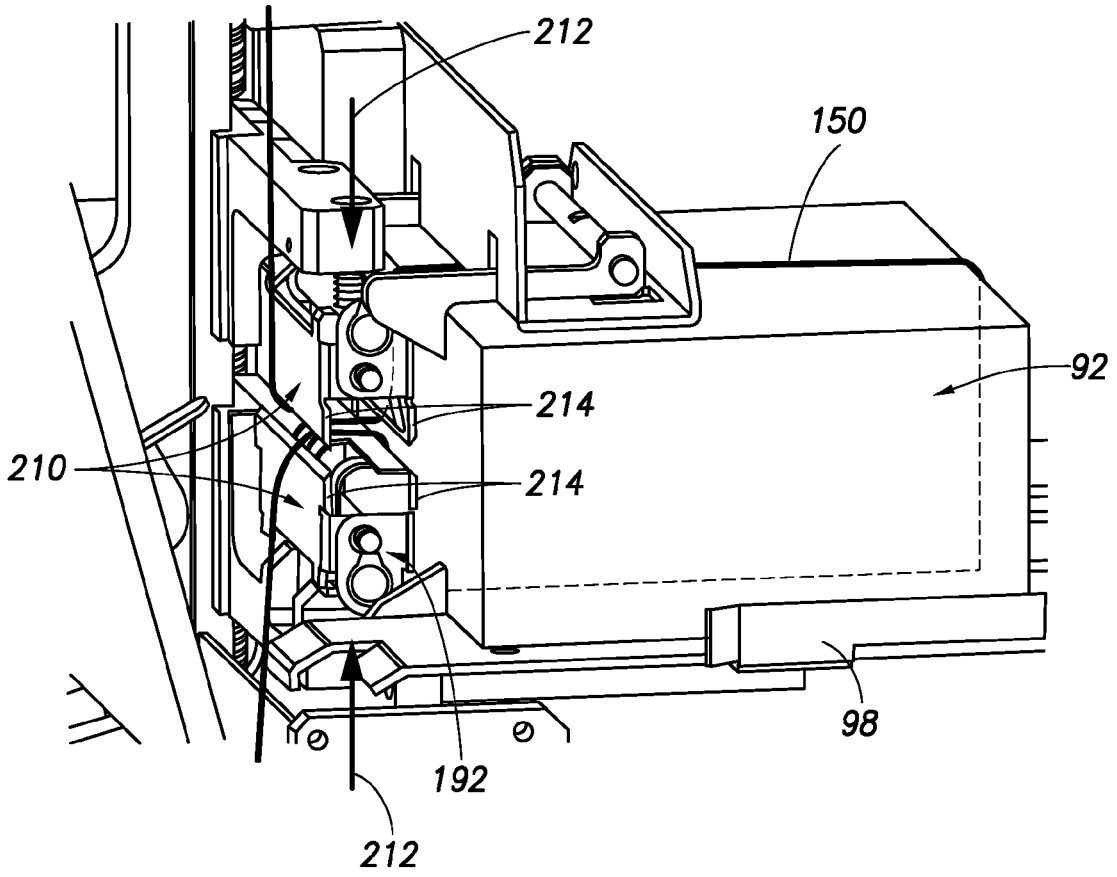

The sealing assembly 192 may be used to cut and seal the wrapping material 150 around an outer periphery of the group 92 of bank notes. As illustrated in FIG. 4G, the sealing assembly 192 may include two oppositely facing sealing components 210. These two sealing components 210 may be brought together (arrows 212) once the group 92 of bank notes is disposed in place on the outlet tray 98. Each of the sealing components 210 may feature two respective clamp arms 214 used to hold and/or cut a portion of the wrapping material 150 as desired.

Figure 4H:
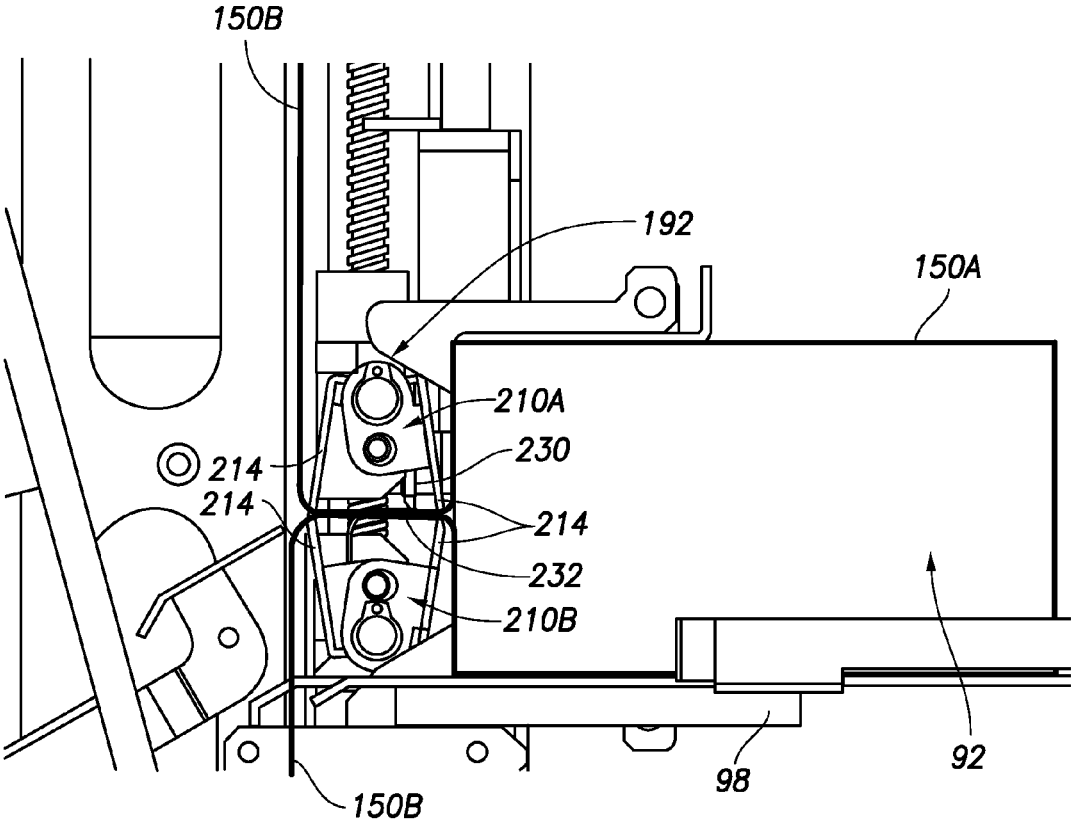

FIG. 4H provides a more detailed view of the sealing assembly 192 being used to close and seal the wrapping material 150 around the group 92 of bank notes. As illustrated, one of the sealing components 210A may feature a welding or cutting tool 230, while the opposite sealing component 210B may feature a supporting surface 232 for the welding/cutting tool 230. As the sealing components 210 are brought together, the respective clamp arms 214 on each of the sealing components 210A and 210B may be pushed away from each other. That is, the clamp arms 214 of the sealing component 210A may rotate relative to each other to move the clamp arms 214 away from each other. Similarly, the clamp arms 214 of the sealing component 210B may rotate to move away from each other.

The clamp arms 214 of the upper sealing component 210A may push against the clamp arms 214 of the lower sealing component 210B as they move outward from each other, thus applying a tension force to the section of wrapping material 150 disposed between the sealing components 210. This tension force may stretch the two pieces of wrapping material 150 (extending from the upper and lower sides of the group 92 of bank notes) over the supporting surface 232. In this position, the welding/cutting tool 230 may provide a relatively accurate weld, cut, crimp, or other operation used to complete the seal of the wrapping material 150 around the periphery of the group 92 of bank notes. In addition to sealing the wrapping material 150, the sealing assembly 192 may sever the portion of the wrapping material 150A disposed around the group 92 of bank notes from the portion of the wrapping material 150B extending between the two spools. Once severed, the clamp arms 214 may become free to pivot into the fully open position as shown in FIG. 4H, thus pulling the sealed ends of the wrapping material 150 away from the welding/cutting tool 230 to facilitate cooling. Thus, the section of wrapping material 150A may be wrapped entirely around a periphery of the group 92, while the other section of wrapping material 150B may remain positioned between the spools to be wrapped around the next incoming group 92 of bank note stacks.

Figure 4I:
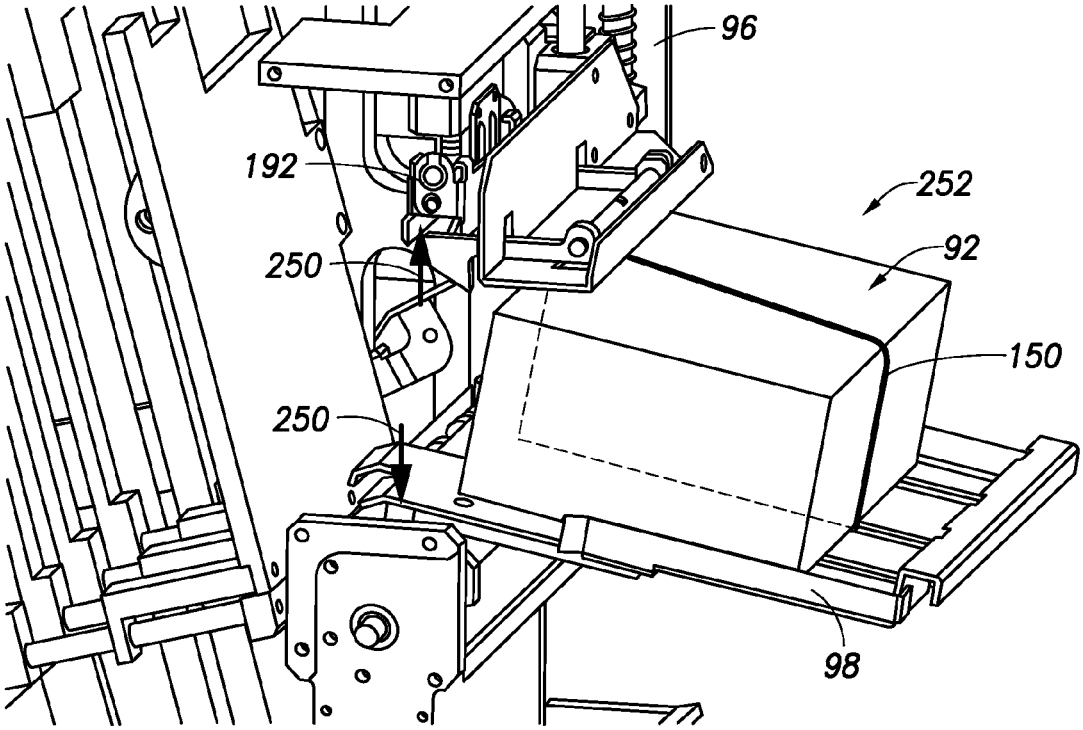

After this, the sealing assembly 192 may be returned to an initial position with the sealing components separated, as shown via arrows 250 in FIG. 4I. The outlet tray 98 may be designed to rotate with respect to the outer frame 96 of the in-line bundler 24. This may enable a completed bundle (i.e., group 92 of bank note stacks surrounded by wrapping material 150) to slide along the tilted surface of the tray 98 and out of the in-line bundler 24. In the illustrated embodiment, the outlet tray 98 may rotate about a hinge along the edge of the outlet tray 98 where it meets the lower portion of the sealing assembly 192. In other embodiments, the outlet tray 98 may rotate about a side edge of the tray extending outward from the in-line bundler. Other arrangements may be utilized in other embodiments to output the bundle 252 of bank notes appropriately sized for transportation.

Although the present disclosure and its advantages have been described in detail, it should be understood that various changes, substitutions and alterations can be made herein without departing from the spirit and scope of the disclosure as defined by the following claims

What is claimed is:

1. A bank note processing system, comprising:

a conveying path for transporting bank notes through the bank note processing system;

a stacking apparatus for receiving the bank notes delivered via the conveying path and stacking the bank notes into a plurality of bank note stacks, wherein each bank note stack comprises a number of bank notes strapped together; and an in-line bundler comprising:

a receptacle for vertically receiving the plurality of bank note stacks from the stacking apparatus;

a rotation mechanism for rotating the plurality of bank note stacks from a vertical orientation to a horizontal orientation;

two spools of wrapping material for wrapping the plurality of bank note stacks, wherein the wrapping material is held in tension between the two spools; and an actuation mechanism for pushing the horizontally oriented plurality of bank note stacks from the receptacle through the wrapping material extending between the two spools to wrap the plurality of bank note stacks into a bundle sized for transportation.

2. The bank note processing system of claim 1, further comprising a motor control section coupled to moveable pieces of the conveying path, wherein the motor control section is configured to manipulate the operation of the conveying path based on control signals received from a central processor.

3. The bank note processing system of claim 1, further comprising a chassis for holding the conveying path, the stacking apparatus, and the in-line bundler in relation to each other.

4. The bank note processing system of claim 1, further comprising a plurality of in-line bundler assemblies, each of the plurality of in-line bundler assemblies comprising a respective in-line bundler, stacking apparatus, and a portion of the conveying path.

5. The bank note processing system of claim 4, further comprising a scanner assembly for scanning the bank notes fed through the conveying path to determine a characteristic of the bank notes, and a central processor for controlling operation of the conveying path to deliver the bank notes to the appropriate in-line bundler assemblies based on the determined characteristic.

6. The bank note processing system of claim 4, wherein each of the plurality of in-line bundler assemblies is a modular unit that can be added to or removed from the bank note processing system.

7. The bank note processing system of claim 1, wherein the in-line bundler further comprises an outlet tray for outputting the bundle from the bank note processing system.

8. A bank note bundler system, comprising:

a receptacle for vertically receiving a plurality of bank note stacks, wherein each bank note stack comprises a number of bank notes strapped together;

two spools of wrapping material for wrapping the plurality of bank note stacks, wherein the wrapping material is held in tension between the two spools;

a rotation mechanism for rotating the bank note stacks from a vertical orientation to a horizontal orientation;

an actuation mechanism for pushing the horizontally oriented plurality of bank note stacks from the receptacle through the wrapping material extending between the two spools to wrap the plurality of bank note stacks into a bundle; and an outlet tray for outputting the bundle from the bank note bundler system.

9. The bank note bundler system of claim 8, further comprising a sealing assembly for cutting and sealing the wrapping material around an outer periphery of the plurality of bank note stacks to form the bundle.

10. The bank note bundler system of claim 9, wherein the sealing assembly comprises a first sealing component having a welding/cutting tool and a second sealing component having a supporting surface for the welding/cutting tool.

11. The bank note bundler system of claim 8, further comprising an outer frame for removably coupling the bank note bundler system to a structural feature of an in-line bundler assembly.

12. The bank note bundler system of claim 8, wherein the receptacle is rotatable within the bank note bundler system.

13. The bank note bundler system of claim 8, wherein the actuation mechanism comprises a hydraulic piston shaped to fit through slots in the receptacle to push the plurality of bank note stacks.

14. The bank note bundler system of claim 8, further comprising a platform for initially receiving the plurality of bank note stacks and lowering the bank note stacks into the receptacle.

15. A method, comprising:

stacking bank notes into a plurality of bank note stacks via a stacking apparatus disposed in an in-line bundler assembly, wherein each bank note stack comprises a number of bank notes strapped together;

vertically disposing the plurality of bank note stacks into an in-line bundler within the in-line bundler assembly;

rotating the bank note stacks from a vertical orientation to a horizontal orientation within the in-line bundler assembly;

pushing the bank note stacks horizontally towards a wrapping assembly;

wrapping the plurality of bank note stacks into a bundle via the wrapping assembly; and outputting the bundle from the in-line bundler assembly.

16. The method of claim 15, further comprising sorting bank notes having a certain characteristic into the in-line bundler assembly for stacking and bundling.

17. The method of claim 15, wherein wrapping the plurality of stacks of bank notes comprises sealing a wrapping material around a periphery of the plurality of stacks.

18. The method of claim 17, comprising cutting the wrapping material into a first section sealed around plurality of bank note stacks and a second section extending between two spools.

19. The method of claim 15, further comprising pushing the bank note stacks horizontally through wrapping material extending between two spools of the wrapping assembly.

* * * * *